US012234065B2

(12) United States Patent
López Masagué

(10) Patent No.: US 12,234,065 B2
(45) Date of Patent: Feb. 25, 2025

(54) TRAY FOR TRANSPORT AND STORAGE OF PRODUCTS AND METHOD FOR USE THEREOF

(71) Applicant: Embalajes Capsa, S.L., Barcelona (ES)

(72) Inventor: Manuel López Masagué, Barcelona (ES)

(73) Assignee: Embalajes Capsa, S.L., Barcelona (ES)

( * ) Notice: Subject to any disclaimer, the term of this patent is extended or adjusted under 35 U.S.C. 154(b) by 0 days.

(21) Appl. No.: 18/081,911

(22) Filed: Dec. 15, 2022

(65) Prior Publication Data

US 2023/0123075 A1 Apr. 20, 2023

Related U.S. Application Data

(63) Continuation of application No. PCT/ES2021/070444, filed on Jun. 16, 2021.

(30) Foreign Application Priority Data

Jun. 16, 2020 (EP) ..... 20382519

(51) Int. Cl.
*B65D 5/10* (2006.01)
*B65D 5/468* (2006.01)

(52) U.S. Cl.
CPC ..... *B65D 5/103* (2013.01); *B65D 5/4608* (2013.01)

(58) Field of Classification Search
CPC ..... B65D 5/103; B65D 5/4608; B65D 5/10; B65D 5/001; B65D 5/0281; B65D 5/443;
(Continued)

(56) References Cited

U.S. PATENT DOCUMENTS 3,182,888 A 5/1965 Chidsey, Jr. et al.
4,187,976 A 2/1980 Mather
(Continued)

FOREIGN PATENT DOCUMENTS

DE 102014011347 A1 2/2016
EP 0541233 A1 5/1993
FR 1549560 A 12/1968

OTHER PUBLICATIONS

International Search Report and Written Opinion in PCT/ES2021/070444, mailed Oct. 29, 2021, 11 pages.

*Primary Examiner* — Christopher R Demeree
(74) *Attorney, Agent, or Firm* — Edell, Shapiro & Finnan, LLC

(57) ABSTRACT

A tray comprises a foldable sheet including: a bottom having a first sector with a folding line that defines a first joining zone, and a second sector joined to the first sector in the first joining zone; end walls each having an interior surface; support surfaces each extending from an end wall, where the support surfaces are oriented to support the weight of another stacked tray; first flaps each extending from a support surface, where each of the first flaps is folded towards an interior of the tray and having a surface facing and separated from the interior surface of an end wall; side walls; and a second flap extending from a side wall. The second flap is placeable a first position on a side wall for reinforcement and in a second position substantially perpendicular to the side walls to serve as a lid.

18 Claims, 6 Drawing Sheets

(58) Field of Classification Search
CPC .. B65D 5/6602; B65D 5/6605; Y10S 229/919
USPC ..... 229/185, 126, 103, 122.32
See application file for complete search history.

(56) References Cited

U.S. PATENT DOCUMENTS

| | | | | |
|---|---|---|---|---|
| 7,472,819 | B1 | 1/2009 | Wachter | |
| 8,668,132 | B2 * | 3/2014 | Lopez Masague .... | B65D 5/003 229/122 |
| 8,915,420 | B2 * | 12/2014 | Masague ..... | B65D 5/6605 229/126 |
| 9,643,748 | B2 * | 5/2017 | Lopez Masague ..... | B65D 5/10 |
| 2006/0219765 | A1 | 10/2006 | Snyder | |

* cited by examiner

TRAY FOR TRANSPORT AND STORAGE OF PRODUCTS AND METHOD FOR USE THEREOF

CROSS REFERENCE TO RELATED APPLICATIONS

This application is a continuation of International Application No. PCT/ES2021/070444, filed on Jun. 16, 2021, which claims priority under 35 U.S.C. § 119(a)-(d) to Application No. EP 20382519.5 filed on Jun. 16, 2020, the entire contents of which are hereby incorporated by reference.

TECHNICAL FIELD

The present disclosure refers to a tray for transport and storage of products, formed from a sheet that defines a bottom, a pair of side walls, and a pair of end walls. The present disclosure also refers to a method for using such a tray.

BACKGROUND

It is common to use trays for transport and storage of products, for example food, particularly fruit, which are formed from a sheet provided with a series of folding lines that define a bottom, a pair of side walls and a pair of end walls.

This sheet, which is normally made of compact cardboard, is transported in its folded flat position to take up as little space as possible. Thus, in the place where it is filled with the products to be transported, the tray is mounted in its position of use, where the side walls and the end walls are substantially perpendicular to the bottom.

For the transport and storage of these product-filled trays, it is common for them to be stacked, which is why it is necessary to reinforce them, which is usually done by forming reinforcing columns at the corners of the tray.

The use of these reinforcing columns presents disadvantages, since they make the tray folding operation difficult when it is empty.

Other trays solve the stacking via flaps that arise from the ends and are glued on the side walls, often requiring specific gluing machinery for their assembly. This makes it impossible for them to be folded for storage once they are finished.

Currently known product transport and storage trays also have the feature that the bottom is a continuous surface of a single material thickness, so that the bottom may not be strong enough to transport products with a certain weight.

In addition, the currently known product transport and storage trays do not comprise any built-in lid, so that the products are not fully protected during transport.

Some trays have flaps that arise from the top and fold inwardly to form a double wall. It is very frequently applied to the walls that make up the end walls. This is because the end walls usually incorporate handles that facilitate the handling of the tray, this double wall is a reinforcement for the handles, since they are created by crossing the at least two layers of material in each end wall, so that the contents of the tray, even if it incorporates a cover, it would be exposed to the outside through the handles. Likewise, the content usually comes into contact with the hands that are inserted through the handles, it can even come out of the tray through them.

Therefore, there is a clear need for a tray for transport and storage of products that has a sufficient resistance to vertical compression, both in the end walls and in the bottom, and that can be manufactured, folded and deployed in the most possible efficient simple and fast way.

SUMMARY

With the disclosed tray for transport and storage of products, the aforementioned disadvantages are solved, presenting other advantages that will be described below.

The tray for transport and storage of products according to the present disclosure is formed from a sheet that defines a bottom, a pair of end walls and a pair of side walls, the bottom comprising a first sector provided with a folding line, which is preferably oblique, which defines a first joining zone, and a second sector connected to the first sector in the first joining zone, wherein each end wall comprises a support surface, which in its use position is placed in a substantially horizontal position to support the weight of another stacked tray.

In addition, each end wall also comprises a first flap that defines a surface facing the end wall, in its position of use, that extends from its upper edge and the support surface is located between the end wall and the first flap, so that, in the position of use, the first flap folds towards the inside of the tray, the surface of the first flap being oriented towards the end wall separated from the interior surface of the end wall.

In this way, the folding and unfolding of the tray is facilitated. This sheet can be of any suitable material, such as, for example, compact cardboard or corrugated cardboard or any other corrugated material.

Furthermore, according to a preferred example, the bottom also comprises a third sector provided with a folding line, which is preferably oblique, which defines a second joining zone, and a fourth sector connected to the third sector in the second joining zone.

Each end wall may also advantageously comprise a first flap extending from its upper edge and the support surface is located between the end wall and the first flap, so that, in the use position, the first flap is folded inwardly and it acts as an interior wall forming an acute angle, less than 90 degrees, with respect to the end wall. The degrees of this angle depend on the width of the support surface, the greater the angle the wider the surface.

Thus, the tray according to the present disclosure has a sufficient vertical compression resistance to allow several trays to be stacked on top of each other, but without the need to form complicated reinforcing columns. In the case of the tray being made of corrugated material, the structure would benefit from a positioning of the material channels perpendicular to the bottom in the side walls and in their end walls, as well as a positioning perpendicular to the slits that delimit the support surface and the first flap.

In some cases, a corrugated material can be used with the material channels arranged in an oblique direction, so that the channel direction in the side walls and in the end walls is positioned obliquely with respect to the bottom, providing resistance in all directions of the tray, regardless of the position of use.

Advantageously, the sheet comprises a single mounting flap that extends from an end wall or side wall and, in the mounting position, is attached (by, for example, glue or staples) to an opposite side wall or end wall.

To make the construction of the tray more resistant, each first flap comprises at least one projection at its distal end which, in the position of use of the tray, is housed in at least one complementary hole, and the at least one complementary hole can be arranged in the end wall at an intermediate height, at its lower part or at the bottom of the tray.

Furthermore, each side wall may also advantageously comprise a second flap extending from the upper end of each side wall, and the second flaps are foldable in their position of use on the side walls, or they are positioned substantially perpendicular to the side walls for use as a lid.

That is, the second flap or flaps can be placed in two use positions:

- a first use position in which they are placed on the side walls, for their use as reinforcement of the side walls,
- a second use position in which they are placed substantially perpendicular to the side walls for their use as a lid.

Furthermore, between an edge of the first flap and an adjacent edge of the second flap a separating groove is defined, and the side walls are joined to the end walls by folding lines, each folding line being displaced with respect to the edges.

Furthermore, the width of the first flap is lower than the width of its end wall.

This allows the tray for transport and storage of products to be shaped to be used as an open tray or as a tray with a lid, being able to alternate between one and the other arrangement as many times as desired. This is achieved because external elements such as glue, staples or any other fixing element are not necessary to make the transition between one arrangement and the other, nor does it imply the need to break the material that makes up the tray at any point.

When used as a lid, the second flaps can comprise at least one slot or tongue for engaging with each other.

In order to facilitate their transport, the end walls can comprise holes as handles.

Since the interior surfaces of the end wall and the first flap are separated from each other by a previously mentioned support surface, this provides the advantage of being able to insert the fingers through the handle located in the end wall and house them between the end wall and the first flap. In this way, the first flap does not need to be pierced. This allows the contents of the tray to be completely isolated from the outside and the hand not to interfere with the contents when using the handle.

According to a possible example, in order to reinforce and facilitate the stacking, each end wall comprises projections on their upper part for their housing in holes located in the lower part of the end wall of a tray stacked on top. These projections would benefit from a vertical positioning of the channels that would make up the material of the projections in the case of the tray being made from a corrugated material.

According to a possible example, each of the first flaps comprises a flange of similar length to the support surface that, in its position of use, is in contact with the bottom of the tray and that maintains the end wall and the first flap substantially parallel to each other.

According to a second aspect, the present disclosure refers to a method for using the tray described above, comprising:

- the use of the tray in a first position, in which the second flap or flaps are placed on the side walls, for use as reinforcement of the side walls,
- the use of the tray in a second position, in which the second flap or flaps are placed substantially perpendicular to the side walls for use as a lid.

In the method, for placing the second flap or flaps in the second position from the first position, or vice versa, each support surface is placed in a substantially vertical position, the first flap being substantially parallel and in contact with the inside of the corresponding end wall.

It should be noted that the assembly and folding of the box is carried out without the need for additional elements, such as, for example, adhesive tape.

BRIEF DESCRIPTION OF THE DRAWINGS

For better understanding of what has been disclosed, some drawings in which, schematically and only by way of a non-limiting example, a practical case of implementation is shown.

DETAILED DESCRIPTION

Figure 1:
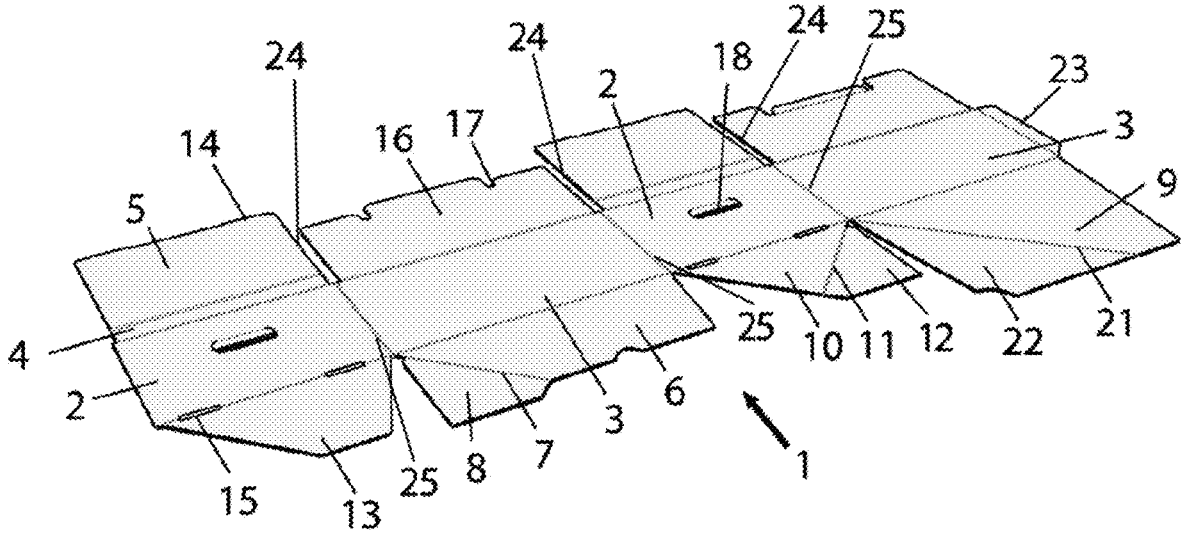
FIG. 1 is a perspective view of an unfolded sheet that forms the tray for transport and storage of products of the present disclosure, according to a first example.

FIG. 1 shows the unfolded sheet that forms the tray for transport and storage of products according to a first example of the present disclosure. This sheet can be of any suitable material, such as, for example, compact cardboard, corrugated cardboard, or other corrugated material.

Figure 5:
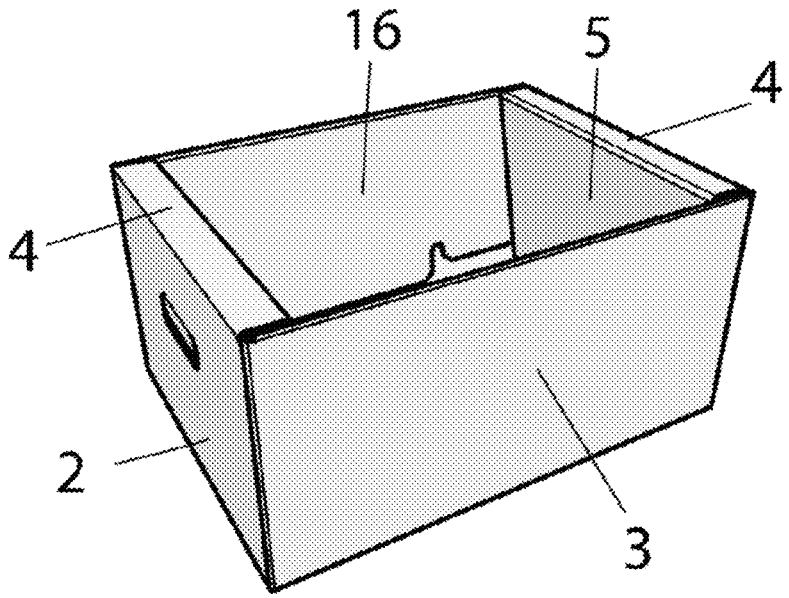
FIG. 5 is a perspective view of the tray for transport and storage of products according to the first example in its position of use, with the second flaps placed on the side walls.

The sheet comprises a plurality of fold lines that define a bottom, generally identified by reference number 1, a pair of end walls 2 and a pair of side walls 3, the end walls 2 and side walls 3 extending substantially perpendicular from the bottom 1 in its mounting position, as shown in FIG. 5. In the case of the sheet being formed from a corrugated material, it is desirable that the direction of the channel in both end walls 2 and 3 be substantially perpendicular to the bottom, and also perpendicular to the slits from which are placed the flaps that arise from them.

Furthermore, the sheet comprises a single mounting flap 23 that extends from an end wall 2 or side wall 3 (a side wall 3 in the case of the example shown) and which, in the mounting position, is attached to an opposite side wall 3 or end wall 2 (an end wall 2 in the case of the shown example).

The bottom 1 comprises a first sector 10 provided with an oblique folding line 11 that defines a first joining zone 12, and a second sector 9 joined to the first sector 10 in the first joining zone 12. Furthermore, according to the shown example, the bottom 1 also comprises a third sector 6 provided with an oblique folding line 7 defining a second joining zone 8, and a fourth sector 13 joined to the third sector 6 in the second joining zone 8.

As can be seen in FIG. 1, the second sector 9 covers substantially the entire area of the bottom 1, and it comprises an oblique folding line 21 and a cutout 22, which facilitate folding and unfolding of the bottom 1 and, consequently, of the entire tray. This way, the tray is formed with a double bottom, formed by a double layer of material that gives it greater resistance.

Each of the two end walls 2 comprises a support surface 4, which in its position of use is arranged substantially horizontally, as shown in FIG. 5, and it is used as a base to stack one tray on top of another.

According to this first shown example, each end wall 2 also comprises a first flap 5, which extends from and is articulated with respect to the top end of the end wall 2. As can be seen in the figures, the support surface 4 is located between the first flap 5 and the end wall 2.

Figure 9:
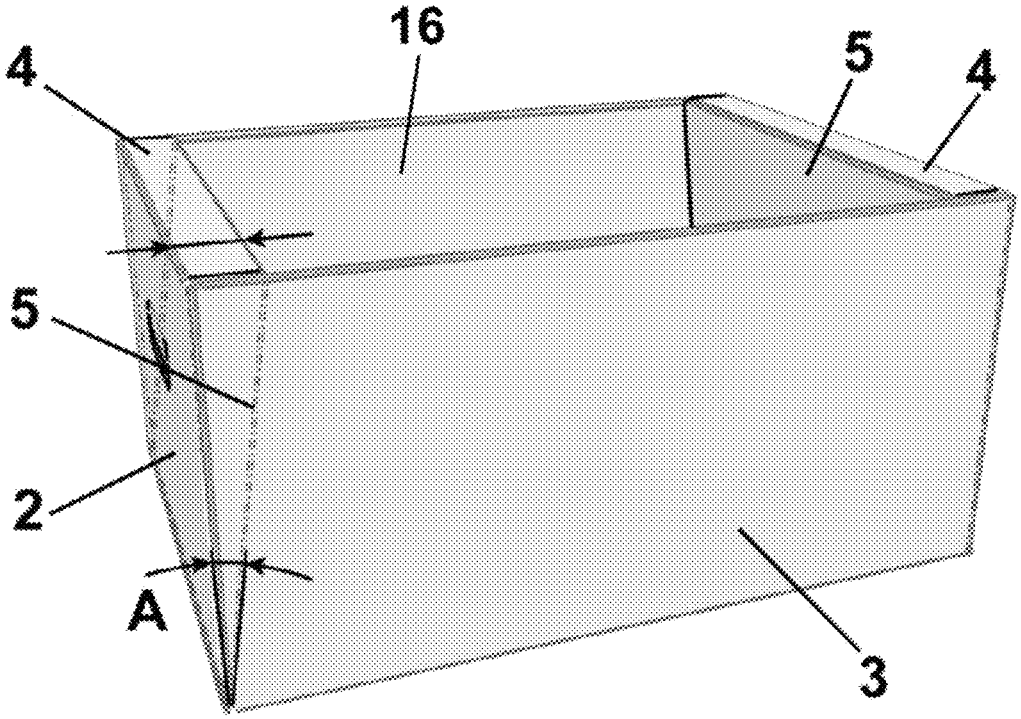
FIG. 9 shows the relationship between the width of the support surface and the angle formed by the end wall and the first flap.

In its use position, the first flap 5 forms an acute angle A, less than 90 degrees, with respect to the end wall 2. As shown in FIG. 9, the degrees of this angle A depend on the width of the support surface, the angle being greater the wider the surface.

In order to facilitate its placement in this position, the first flaps 5 comprise at their distal end, that is, at the farthest from the end wall 2 in their deployed position, one or more projections 14, which are housed in complementary holes 15 when the tray is mounted. In this example, the holes 15 are located at the bottom of the end walls 2, although they could also be located at the bottom of the tray, at the intersection between each end wall, at the bottom or at a certain height in the end wall.

The end walls 3 can incorporate a combination of at least one cut and at least one slit that hinge a flap 18 whose negative gap acts as a handle. The flap 18, folded inwardly and housed between the end wall 3 and the first flap 5, strengthens the handle, helping to prevent the material from tearing, as it has to bear the weight of the contents of the tray. Additionally, it provides a more comfortable grip for handling.

Figure 3:
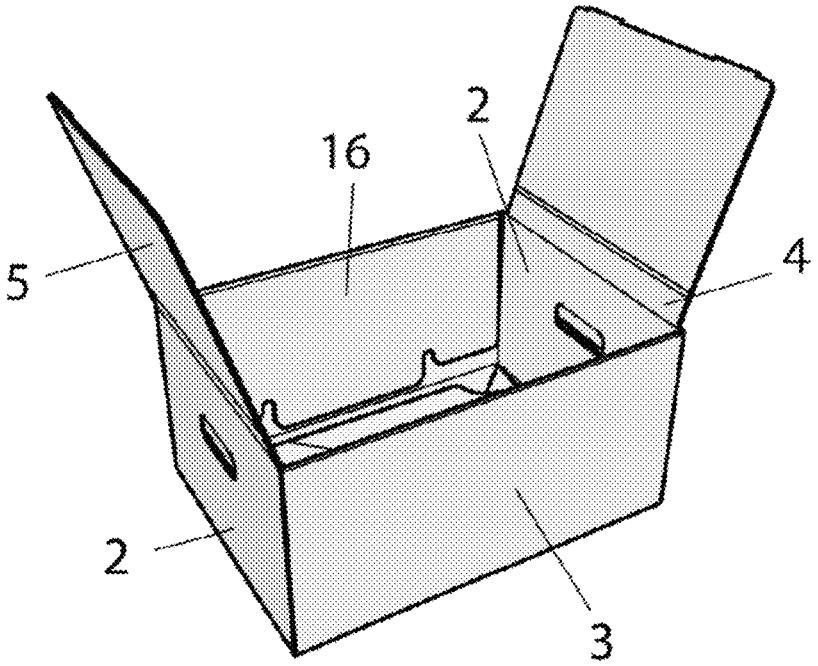

From each of the two side walls 3 a second flap 16 extends, which is hinged at the upper end of the side wall 3. The second flaps 16 have a double function. Firstly, they can be used to reinforce the side walls 3, as shown in FIG. 3, and secondly, they can be used as a lid, as shown in FIG. 7.

Figure 7:
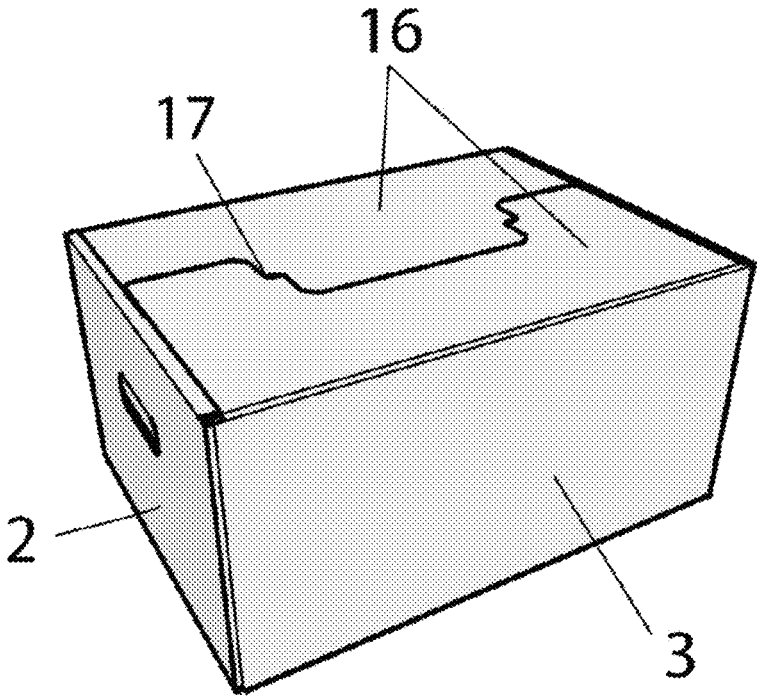

To use them as a lid, these second flaps 16 can comprise at least one slot 17 for their coupling with each other, as shown in FIG. 7.

Furthermore, between an edge of the first flap 5 and an edge of the adjacent second flap 16 a separation groove 24 is defined, and the side walls 3 are joined to the end walls 2 by folding lines 25, each folding line 25 being displaced with respect to the edges.

Furthermore, the width of the first flap 5 is lower than the width of its end wall 2.

Figure 2:
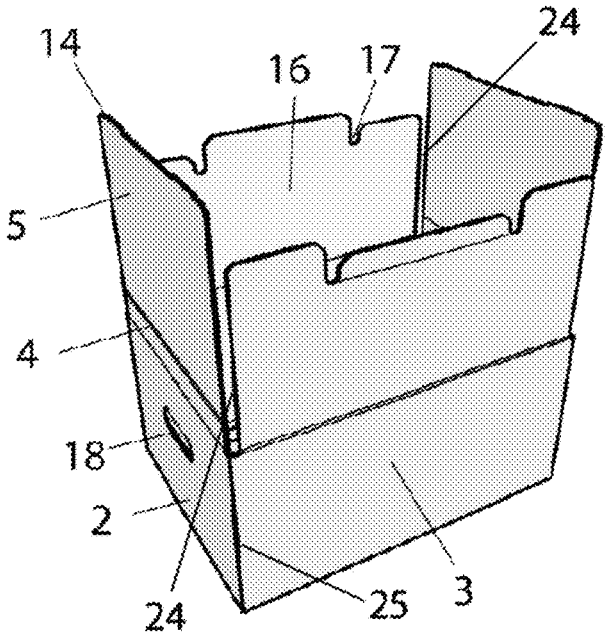
FIGS. 2 to 4 are perspective views of the tray for transport and storage of products according to the first example during its assembly.
Figure 4:
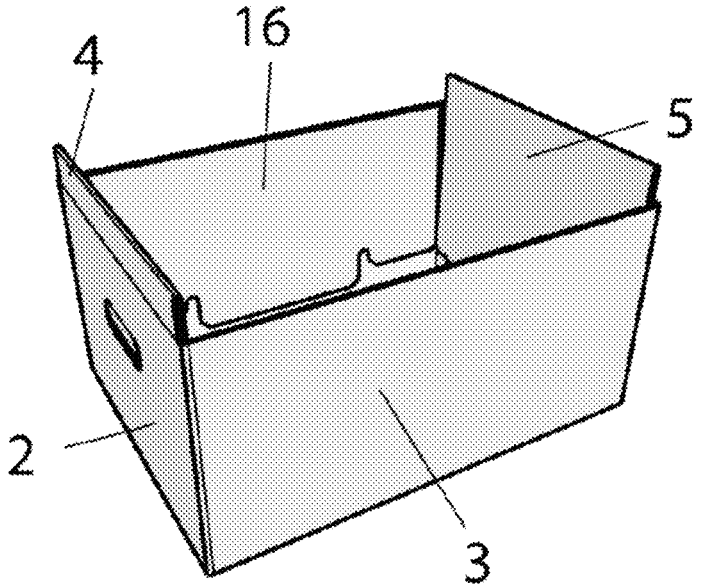

FIGS. 2 to 4 show the tray assembly process according to the present disclosure when the second flaps 16 are used to reinforce the side walls 3.

As shown in FIGS. 2 and 3, with the bottom 1 mounted, the second flaps 16 must first be folded on the side walls 3. Next, the first flaps 5 are folded, leaving the support surfaces 4 in their substantially horizontal position, as shown in FIG. 5.

It should be noted that since the bottom 1 is foldable, the first flaps 5 also serve to avoid accidental folding of the bottom 1. This way, for disassembling or folding the tray, firstly, the first flaps 5 must be moved so that the support surfaces 4 are in a substantially vertical position and this way the structure ready to be folded is unlocked, such as shown in FIG. 4.

These first flaps 5 also serve to hold the second flaps 16 when they are folded into the tray in a position substantially in contact with the side walls 3.

To allow the second flaps 16 to be removed, the procedure is also to move the first flaps 5 so that the support surfaces 4 are in a substantially vertical position and thus stop blocking the second flaps 16.

That is why, both the first flaps 5 and the support surfaces 4 are narrower enough than the width of the end wall 2 to allow the second flap to be housed between the side wall 3 and the edge of the first flap 5 and the support surface 4, with the tray in the use position.

Figure 8:
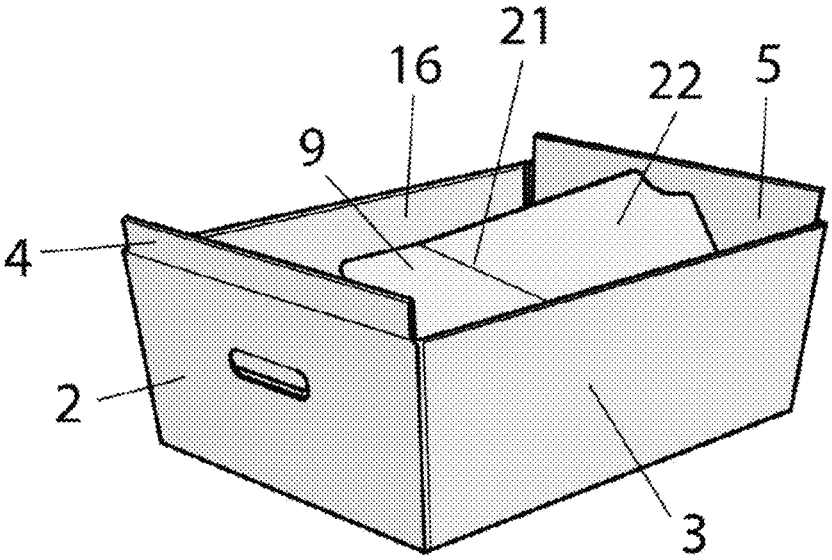
FIG. 8 is a perspective view of the tray for transport and storage of products according to the first example, during its folding.

Also the second flaps 16 are sufficiently narrower than the side wall 3 of the tray, in this case to facilitate the folding of the automatic bottom 1 via the cutout 22 that belongs to the bottom sector 9, both the first flaps 5 and the second flaps 16 being at that time folded inwardly as seen in FIG. 8.

Subsequently, the bottom 1 must be folded, being able to use the cutout 22 in the second sector 9 of the bottom 1, as shown in FIG. 8.

Figure 6:
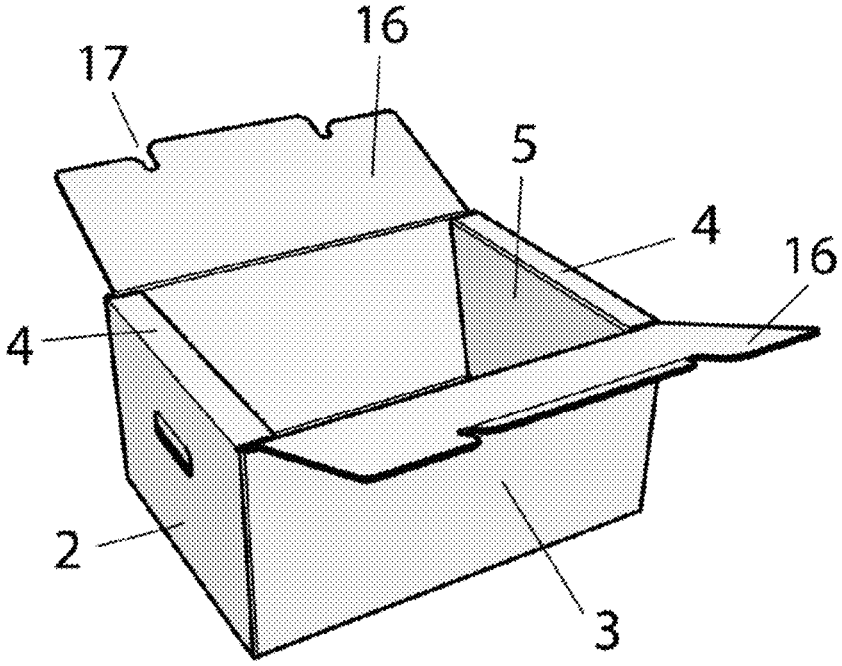
FIGS. 6 and 7 are perspective views of the tray for transport and storage of products according to the first example in its use position, with the second flaps used as a lid, in its open and closed position, respectively.

FIGS. 6 and 7 show the first example of the tray of the present disclosure, but with the second flaps 16 used as a lid, engaged to each other. The support surfaces 4 also serve to support the second flaps 16 in a position substantially perpendicular to the side walls 3, closing the tray. This way, the second flaps 16 that act as a lid are more resistant to collapse in the case of supporting a weight placed on top.

Figure 10:
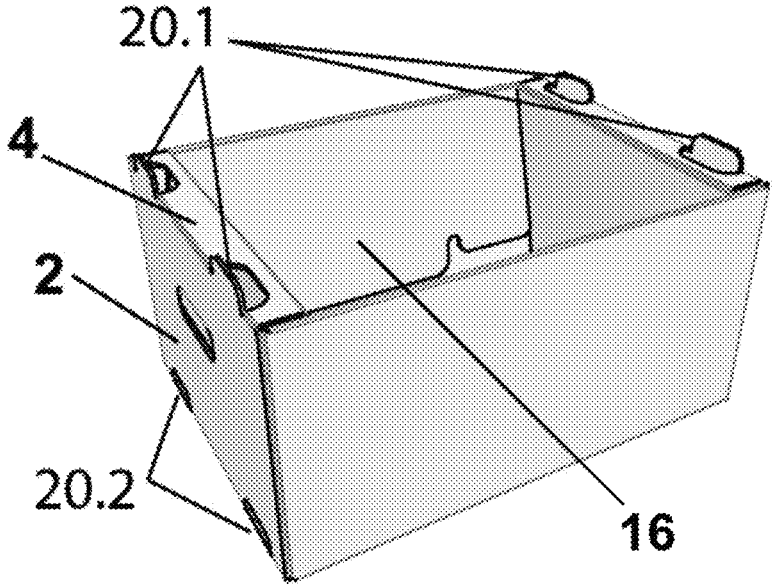
FIG. 10 shows a second example of the tray, which incorporates stacking flanges.

In FIG. 10 a second example of the tray for transport and storage of products according to the following disclosure is shown.

For the sake of clarity and simplicity, the same reference numbers are used to indicate the same elements as in the previous example and, furthermore, only the differences from the example are described.

This figure shows additional elements formed by one or more projections 20.1 located at the top of each end wall 2, in this case two protrusions in each, and two holes 20.2 located at the bottom of each end wall 2, so that the projections 20.1 of a first tray are housed in the holes 20.2 of a second tray on which the first tray is stacked, as shown in FIG. 10. This makes it easy to stack two or more trays on top of each other.

Figure 11:
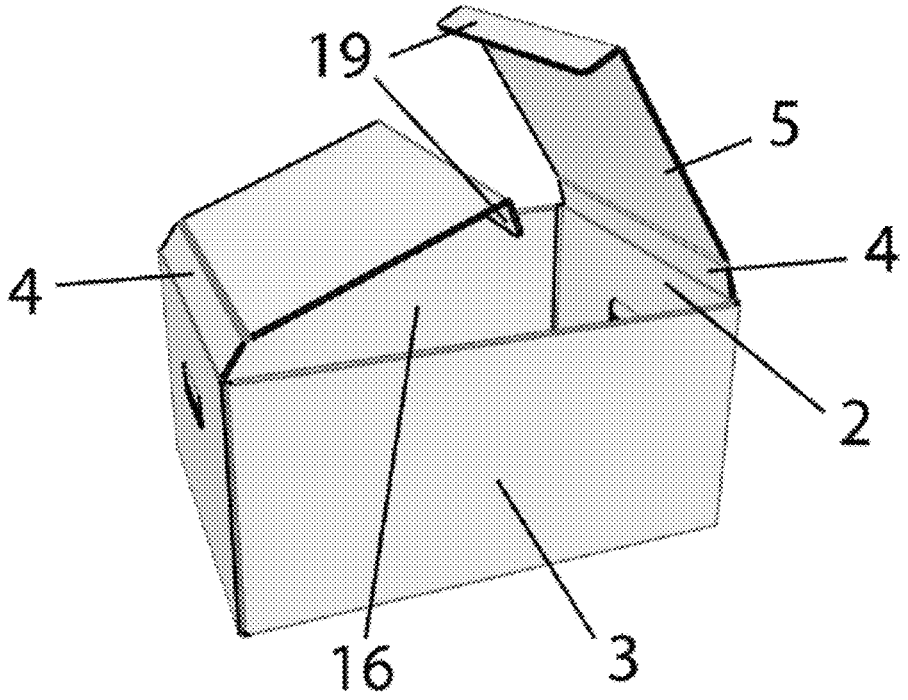
FIGS. 11 and 12 are perspective views of the tray for transport and storage of products according to a third example in its use position, with the first flaps in their deployed and in use position, respectively.
Figure 12:
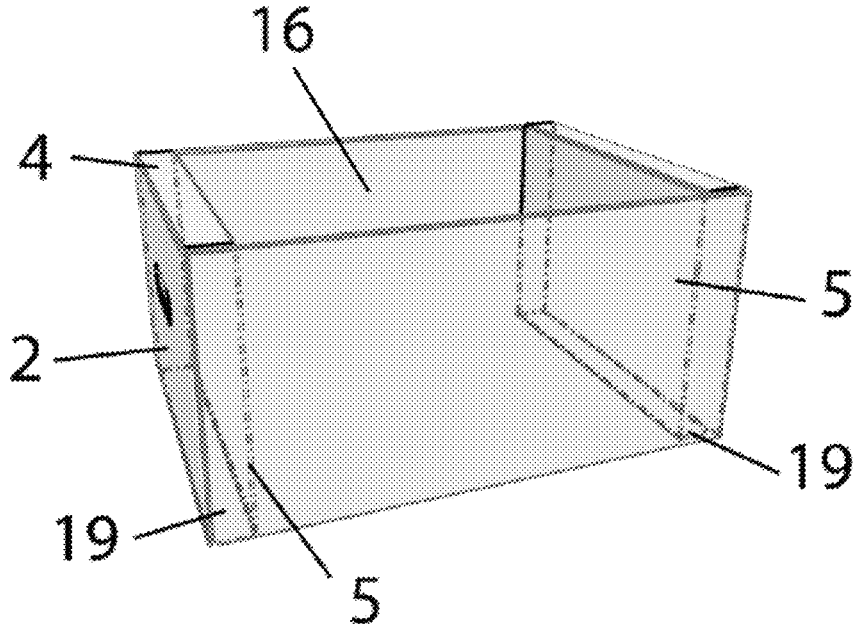

FIGS. 11 and 12 show a third example of the tray for transport and storage of products according to the present disclosure.

For the sake of clarity and simplicity, the same reference numbers are used to indicate the same elements as in the previous example and, furthermore, only the differences from the example are described.

The main difference between this third example and the first example is that the distal end of the first flaps 5 does not comprise any protrusions, but rather comprises a flange 19, which in the position of use is placed on the bottom 1 of the tray, such as can be seen in FIGS. 11 and 12.

The length of the flange 19 is preferably equal to the length of the support surface 4 and thus the end wall 2 and the first flap 5 or inner wall would be substantially parallel.

As indicated above, the method for using the tray described above comprises:

- the use of the tray in a first position, in which the second flaps 16 are placed on the side walls 3, for use as reinforcement of the side walls 3, the use of the tray in a second position, in which the second flap or flaps 16 are placed substantially perpendicular to the side walls 3 for use as a lid.

In this method, to place the second flap(s) 16 in the second position from the first position, or vice versa, each supporting surface 4 is placed in a substantially vertical position, the first flap 5 being substantially parallel and in contact with the internal part of the corresponding end wall 2.

Alternatively, for placing the second flap(s) 16 in the second position from the first position, or vice versa, the first flap 5 and the support surface 4 are placed vertically above the end wall 2.

Although reference has been made to specific examples of the disclosure, it is apparent to a person skilled in the art that the described tray for transport and storage of products is susceptible of numerous variations and modifications, and that all the details mentioned can be replaced by other technically equivalents, without departing from the scope of protection defined by the appended claims.

What is claimed is:

1. A tray for transport and storage of products, comprising:

a foldable sheet that, when folded to define the tray, comprises:

a bottom including a first sector having a folding line that defines a first joining zone, and a second sector joined to the first sector in the first joining zone;

end walls each having an interior surface;

support surfaces each extending from an end of a respective one of the end walls, the support surfaces being oriented substantially perpendicular to the interior surfaces of the end walls to enable support of a weight of another stacked tray;

first flaps each extending from an end of a respective one of the support surfaces such that each of the support surfaces is located on the foldable sheet between a respective one of the end walls and a respective one of the first flaps, each of the first flaps being folded towards an interior of the tray and having a surface facing and separated from the interior surface of a respective one of the end walls;

side walls; and a second flap extending from an end of one of the side walls, wherein the second flap is placeable in two alternative use positions of the tray: a first position in which the second flap is placed on the one of the side walls in a position to provide reinforcement against vertical compression of that side wall during stacking of the tray with other trays;

and a second position in which the second flap is placed substantially perpendicular with respect to the side walls to serve as a lid for the tray.

2. The tray of claim 1, wherein a separation groove is defined between an edge of one of the first flaps and an edge of the second flap.

3. The tray of claim 2, wherein the side walls are joined to the end walls by folding lines, each folding line being displaced with respect to edges of the first flaps and second flap.

4. The tray of claim 1, wherein the width of the first flaps is less than the width of the end walls.

5. The tray of claim 1, wherein the bottom further comprises a third sector having a folding line defining a second joining zone, and a fourth sector connected to the third sector in the second joining zone.

6. The tray of claim 1, wherein each of the first flaps maintains its respective one of the support surfaces substantially horizontal.

7. The tray of claim 6, wherein each of the first flaps comprises a projection at its distal end which is housed in a complementary hole.

8. The tray of claim 6, wherein each of the first flaps comprises a flange capable of contacting the bottom of the tray.

9. The tray of claim 1, wherein the foldable sheet further comprises at least one mounting flap that extends from one of the end walls or side walls and wherein, in a mounting position, is attached to an opposite one of the end walls or side walls.

10. The tray of claim 1, wherein the second flap comprises a slot or a tab for closing the tray.

11. The tray of claim 1, wherein the second flap is one of a pair of second flaps and one of the second flaps comprises a slot for engaging the other of the second flaps.

12. The tray of claim 1, wherein the end walls comprise holes as handles.

13. The tray of claim 12, wherein the handles are delimited by a series of at least one cut and at least one slit that generate a flap, and wherein the flap is insertable into a space between one of the end walls and first flaps.

14. The tray of claim 1, wherein the end walls comprise holes for accommodating protrusions complementary of a stacked tray.

15. The tray of claim 1, wherein the foldable sheet comprises a single sheet of corrugated material comprising a plurality of parallel channels in the end walls and side walls that extend in a direction that is perpendicular or oblique with respect to the bottom.

16. A method for using a tray for transport and storage of products, wherein the tray is formed from a foldable sheet that, when folded to define the tray, comprises: a bottom including a first sector having a folding line that defines a first joining zone, and a second sector joined to the first sector in the first joining zone; end walls each having an interior surface; support surfaces each extending from an end of a respective one of the end walls, the support surfaces being oriented substantially perpendicular to the interior surfaces of the end walls to enable support of a weight of another stacked tray; first flaps each extending from an end of a respective one of the support surfaces such that each of the support surfaces is located on the foldable sheet between a respective one of the end walls and a respective one of the first flaps, each of the first flaps being folded towards an interior of the tray and having a surface facing and separated from the interior surface of a respective one of the end walls; side walls; and a second flap extending from an end of one of the side walls, the method comprising:

configuring the tray in a first use position which the second flap is placed on the one of the side walls in a position to provide reinforcement against vertical compression of that side wall during stacking of the tray with other trays; and configuring the tray in a second use position in which the second flap is placed substantially perpendicular with respect to the side walls to serve as a lid for the tray.

17. The method of claim 16, wherein to transition between the first and second positions, each of the support surfaces is placed in a substantially vertical position, with each of the first flaps being substantially parallel and in contact with the internal surface of its respective end wall.

18. The method of claim 16, wherein to transition between the first and second positions, one of the first flaps and its respective one of the support surfaces are placed vertically above the respective one of the end walls.

* * * * *